US005816548A

United States Patent [19]

Blossom III

[11] Patent Number: 5,816,548

[45] Date of Patent: Oct. 6, 1998

[54] VASE WITH ATTACHED MAGNET

[76] Inventor: John T. Blossom III, P.O. Box 121, Los Olivos, Calif. 93441-0121

[21] Appl. No.: 840,554

[22] Filed: Apr. 14, 1997

[51] Int. Cl.[6] ..... A47G 1/17

[52] U.S. Cl. ..... 248/206.5; 206/423

[58] Field of Search ..... 248/206.5, 311.2, 248/686, 683, 205.4

[56] References Cited

U.S. PATENT DOCUMENTS

| | | | |
|---|---|---|---|
| D. 114,349 | 4/1939 | Sparrow . | |
| D. 247,941 | 5/1978 | Gregorius . | |
| D. 365,041 | 12/1995 | Dollinger . | |
| 1,074,239 | 9/1913 | Braun . | |
| 1,226,101 | 5/1917 | Marsden . | |
| 1,758,130 | 5/1930 | Shoemaker . | |
| 1,868,023 | 7/1932 | North . | |
| 2,964,812 | 12/1960 | Cook | 24/10 R |
| 3,109,619 | 11/1963 | Krug et al. . | |
| 3,159,372 | 12/1964 | McIntosh . | |
| 3,713,614 | 1/1973 | Taylor . | |
| 4,137,668 | 2/1979 | Kojo | 47/66.1 |
| 4,976,385 | 12/1990 | Matsumoto | 224/42.42 |
| 5,195,270 | 3/1993 | Domurat | 47/41.01 |
| 5,409,190 | 4/1995 | Mattox | 248/315 |
| 5,522,205 | 6/1996 | Weder | 53/475 |
| 5,564,567 | 10/1996 | Weder | 206/423 |
| 5,613,421 | 3/1997 | Abe | 92/165 |
| 5,662,973 | 9/1997 | Weder | 428/36.9 |

*Primary Examiner*—Leslie A. Braun
*Assistant Examiner*—Robert Lipcsik
*Attorney, Agent, or Firm*—James Yuanxin Li

[57] ABSTRACT

A vase with a permanently attached magnet. The magnet is balanced with the vase's center of gravity so that the vase can stand by itself with no other method of support and/or the magnet can be used to attach the vase to a vertically-oriented magnetically-attractive surface.

1 Claim, 2 Drawing Sheets

VASE WITH ATTACHED MAGNET

FIELD OF THE INVENTION

The invention relates to a novel vase with an attached magnet. The magnet is balanced with the vase's center of gravity so that the vase can stand by itself with no other means of support and/or the magnet can be used to attach the vase to a vertically-oriented magnetically-attractive surface.

BACKGROUND OF THE INVENTION

Flower vases available today generally come in different sizes, weights, and proportions. There are large ones that may hold large arrangements of flowers. There are also small ones that, for example, may hold a single flower or a few stems. Unfortunately, the smaller vases are often unstable.

Vases are generally free-standing with a flat base and no other means to maintain the vase in a vertical position. Further, these vases are generally designed to be placed only upon a horizontal surface. Of these types of vases, those having a large base in proportion to their height are generally more stable. A vase that is tall in relation to the size of its base may be unstable due to its higher center of gravity and is susceptible to being knocked over. Similarly, small vases designed to hold a single flower or small arrangements are also prone to being knocked over accidentally. Additionally, smaller vases are often too lightweight to be used in many situations that require great stability or in situations in which there is a great amount of activity (e.g., on a desk of a busy individual).

This present invention relates to a flower vase comprising a body portion for receiving flowers and liquid, along with an attached magnet. The attached magnet may vary in size and may be composed of iron, nickel, rare earths, or combinations thereof depending on the size and weight of the vase to be supported magnetically.

In one embodiment, the magnet is recessed into a U-shaped groove in the side of the vase. The depth of the U-shaped grove is equal to or less than the thickness of the magnet so that the surface of the magnet may make contact with a magnetically-attractive surface. The depth of the U-shaped groove varies depending on the size and weight of the magnet so that the center of gravity of the vase is not disrupted. The magnet placed within the U-shaped groove permits the vase to remain in balance and allows it to stand freely on a horizontal surface in the usual manner if the magnet feature is not needed.

Alternatively, with the recessed magnet, the user also has the option of attaching the vase to a vertically oriented magnetically-attractive surface such as the side of a metal filing cabinet or a metal desk. The vase may be held in place solely by using the magnet or the vase may rest upon a horizontal surface in conjunction with being kept stable by use of the magnet.

In another embodiment, the magnet attached to the vase extends down vertically so that the lower surface edge of the magnet is in the same plane as the horizontal surface upon which the vase is resting. The lower surface edge of the magnet, in effect, increases the surface area for the base of the vase and provides the vase with greater stability. The lower surface edge will also provide magnetic attraction if the vase is placed upon a magnetically-attractive horizontal surface.

Prior inventions relating to vases and floral displays disclose only methods for mechanically mounting a vase or flower pot against a vertical surface. For example, U.S. Pat. No. 1,074,239 granted to Braun, U.S. Pat. No. 1,226,101 granted to Marsden, U.S. Pat. No. No. 1,758,130 granted to Shoemaker, and U.S. Pat. No. 4,137,668 granted to Kojo all depict variations of floral containers that are designed to be mounted permanently or semi-permanently to vertical surfaces. These prior inventions do not have the advantage of the present invention of allowing the vase to be relocatable on a magnetically-attractive vertical surface or, alternatively, allowing the vase to rest on a horizontal surface.

U.S. Pat. No. 1,868,023 granted to North, U.S. Pat. No. 5,195,270 granted to Domurat, U.S. Pat. No. 5,409,190 granted to Mattox, U.S. Pat. No. Des. 114,349 granted to Sparrow, U.S. Pat. No. Des. 247,941 granted to Gregorius, and U.S. Pat. No. Des. 365,041 granted to Dollinger also depict holders or receptacles that are also designed for use only on vertical surfaces, unlike the present invention which allows for dual usage on either a vertical surface or a horizontal surface. Further, while these other patents propose inventions using suction cups or mechanical designs that permit the containers to be somewhat moveable, these inventions lack the ease of use that the present invention has by incorporation of the magnet.

U.S. Pat. No. 2,964,812 granted to Cook, U.S. Pat. No. 3,109,619 granted to Krug et al., U.S. Pat. No. 3,159,372 granted to McIntosh, and U.S. Pat. No. 3,713,614 granted to Taylor disclose examples of magnets used to hold objects in place on a magnetically-attractive surface. However, in these examples, the magnets serve only as a method to hold generally lightweight objects in place. The magnets are also independent of the objects to which they are attached. In the present invention, the magnet is an integral feature of the vase and is designed so that the center of gravity for the vase is not disrupted. Taking the weight distribution of the vase into account when affixing the magnet permits the present invention to be used both on vertical magnetically-attractive surfaces and/or horizontal non-metal surfaces.

OBJECTS AND ADVANTAGES

It is therefore a primary object of the present invention to provide a vase with a novel method for creating the necessary stability to permit it to be used in a variety of situations that heretofore would otherwise have been impractical. A further object is to permit a flower vase to be mounted to vertically-oriented magnetically-attractive surfaces (e.g., refrigerator doors, file cabinets, lamps, office equipment) so that vases may be placed, without altering the surface, in locations where a vase would not have been previously possible.

Another object is to provide a novel vase that may be used on horizontal surfaces in the usual manner if no magnetically-attractive surfaces are available. A still further object is to provide a vase that may rest upon a horizontal surface but also simultaneously attach itself to a vertical magnetically-attractive surface to achieve great stability in relation to the size and weight of the vase.

Generally stated, the present invention has a magnet permanently attached to one side of the vase. In one embodiment, one end of the magnet is horizontally aligned with the base of the vase. This vase may then either be used on a horizontal surface or attached to a vertically-oriented magnetically-attractive surface. If used on a horizontal surface, such surface may be non-magnetically attractive or magnetically attractive. On a non-magnetically attractive horizontal surface, the physical presence of one end of the magnet in contact with the horizontal surface increases the overall stability of the vase by adding to the surface area of vase's base. On a magnetically-attractive horizontal surface, the base of the vase and the magnetic attraction of the magnet further combine to keep the vase in position. Additionally, the present invention permits the vase to be placed on any vertically-oriented magnetically-attractive surface.

Other objects, features, and advantages of the invention will become apparent to those skilled in the art from a consideration of the detailed description and the accompanying drawings.

DRAWING FIGURES

The present invention will now be described by way of example with reference to the accompanying drawings in which.

Figure 1:
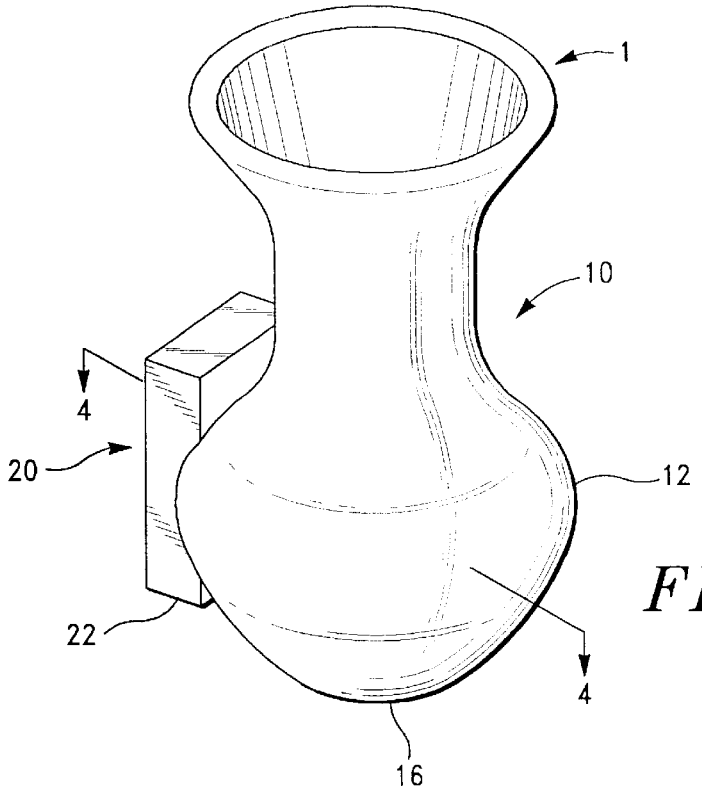
FIG. 1 is a perspective view of the vase with the attached magnet.
Figure 2:
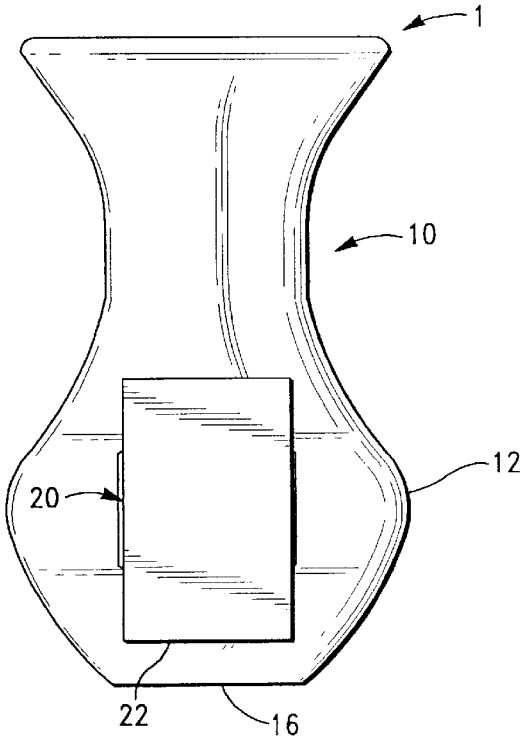
FIG. 2 is a rear view of the vase of FIG. 1 with the attached magnet.
Figure 3:
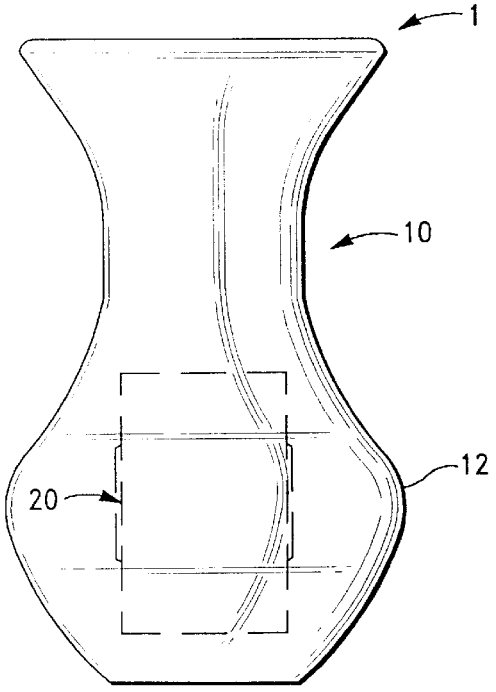
FIG. 3 is a front view of the vase of FIG. 1 with the attached magnet in the rear shown in outline.
Figure 4:
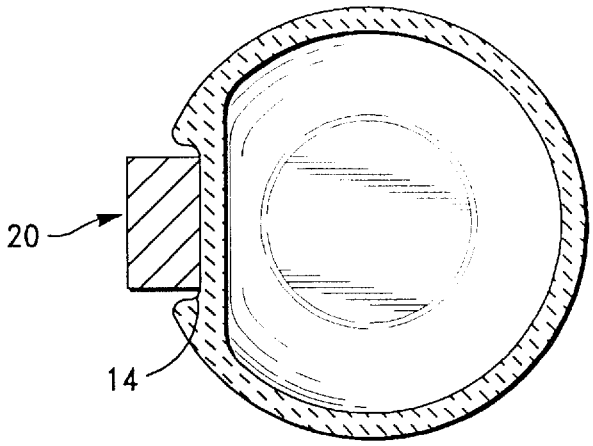
FIG. 4 is a horizontal section view along line 4—4 of the vase of FIG. 1.

| Reference Numbers in Drawings | |
|---|---|
| 1 | vase with attached magnet |
| 10 | vase |
| 12 | lower body of vase |
| 14 | U-shaped groove on side of vase |
| 16 | base of vase |
| 20 | magnet |
| 22 | base of magnet |

DETAILED DESCRIPTION

A typical embodiment of the vase with attached magnet (1) is illustrated in FIGS. 1, 2, 3, and 4. As shown in the drawings, the invention consists of two parts: a vase (10) and an attached magnet (20). The vase may be composed of ceramic, plastic, or other materials suitable for use as a container. The magnet (20) depicted is rectangular but may be of different shapes to suit the size and weight of the vase (10).

The magnet (20) is secured to a vertical U-shaped groove (14) on the side of the vase (10) by any suitable adhesive applied to the surface areas at which the magnet (20) is in contact with the U-shaped groove (14).

In the embodiment shown, the lower body of the vase (12) is manufactured with a vertical U-shaped groove (14) cut into the side of the vase. This U-shaped grove (14) is formed out of the vase's lower body (12) so that, when the magnet (20) is attached, the vase's center of gravity is not disturbed. This permits the vase (10) to remain balanced when the vase (10) is placed upon a horizontal surface and used in the usual manner. The groove (14) may be formed by molding, machining, extruding, forming, or cutting.

Figure 5:
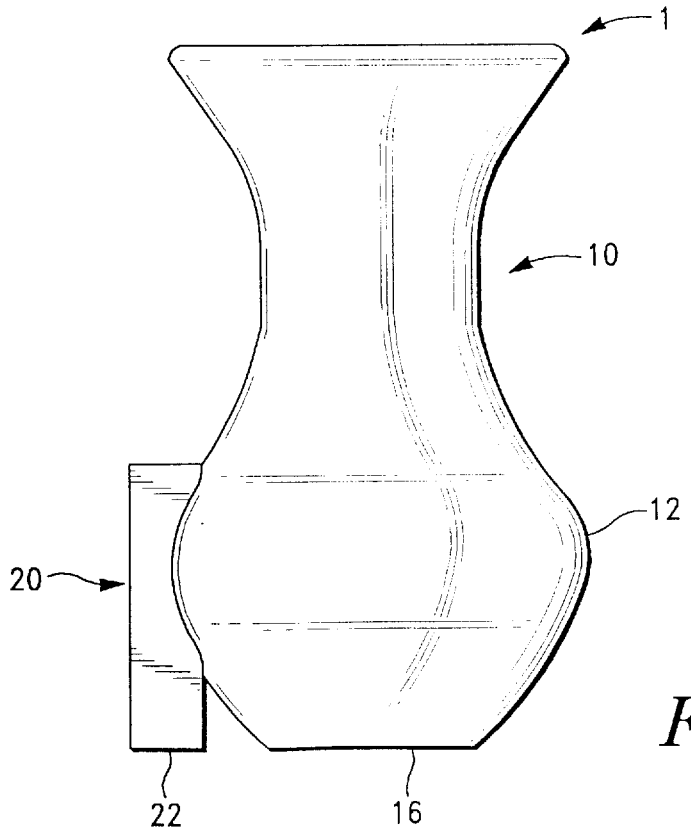
FIG. 5 is a side elevational view of another embodiment of the present invention in which the bottom surface edge of the attached magnet is aligned horizontally in the same plane as the base of the vase.

In the alternate embodiment shown in FIG. 5, the magnet is attached such that the lower base of the magnet (22) is aligned along the same plane as the base of the vase (16). The lower base of the magnet (22) provides additional support to the vase (10) when the vase (10) is placed so that it stands upon a magnetically-attractive surface. On non-metal horizontal surfaces, the surface area for the lower base of the magnet (22) acts to provide greater physical stability for the vase (10).

Although the description above contains many specificities, these should not be construed as limiting the scope of the invention but as merely providing illustrations of some of the presently preferred embodiments of this invention. For example, the vase may be of different shapes and styles other than the classic exemplar shape depicted in the drawings. The magnet may, for example, be circular rather than rectangular. The magnet may also consist of more than one magnet as needed to conform to the shape of the vase or to provide additional support for heavier vases. The magnet may be attached to a groove of various depths or may also be attached with an appropriate adhesive to an otherwise unaltered vase with no groove on its body.

What is claimed is:

1. A vase for exhibiting and retaining a floral arrangement upon a magnetically-attractive surface, comprising:

a) a watertight container adapted to receive stems of a floral arrangement; and b) a magnetic means, comprising a magnet with a substantially flat side for engagement of said vase with a magnetically-attractive surface, with adhesive means to affix said magnet permanently to said watertight container, wherein said vase has a U-shaped groove in which said magnet is embedded to a depth no greater than the thickness of said magnet such that the mass of the vase displaced by the U-shaped groove is equal to the mass of the magnet whereby the center of gravity for said vase remains along the center vertical axis and said vase remains balanced without any independent support.

* * * * *